US008138404B1

(12) United States Patent
Petros

(10) Patent No.: US 8,138,404 B1
(45) Date of Patent: Mar. 20, 2012

(54) STRIP INLAY PRODUCTS, AND METHODS OF MAKING

(76) Inventor: Bruce Petros, Kaukauna, WI (US)

( * ) Notice: Subject to any disclaimer, the term of this patent is extended or adjusted under 35 U.S.C. 154(b) by 0 days.

(21) Appl. No.: 12/928,845

(22) Filed: Dec. 20, 2010

(51) Int. Cl.
*G10D 1/08* (2006.01)

(52) U.S. Cl. ..... 84/291; 84/267

(58) Field of Classification Search ..... 84/267, 84/290, 291, 327; 428/53, 57, 58
See application file for complete search history.

(56) References Cited

U.S. PATENT DOCUMENTS

| | | | | |
|---|---|---|---|---|
| 4,090,427 | A | 5/1978 | Kaman | |
| 4,213,370 | A | 7/1980 | Jones | |
| 4,236,191 | A | 11/1980 | Martinez | |
| 4,304,164 | A | 12/1981 | Baker | |
| 4,367,777 | A | 1/1983 | Baker | |
| 5,776,581 | A | 7/1998 | Sifel et al. | |
| 6,177,622 | B1 | 1/2001 | Green | |
| 6,190,491 | B1 | 2/2001 | Sifel et al. | |
| 7,347,762 | B1 | 3/2008 | Long | |
| 7,507,884 | B2 | 3/2009 | Carlson | |
| 7,579,534 | B1 | 8/2009 | Ryan | |
| 7,820,896 | B2 | 10/2010 | Wang | |
| 8,053,053 | B1 * | 11/2011 | Ryan | 428/58 |
| 2009/0229441 | A1 | 9/2009 | Ryan | |

OTHER PUBLICATIONS

West American Rubber Company, Specification Grade Sheet Rubber Products, website, www.warco.com/sheet/specgrade/#milr68552cl2, printed Dec. 1, 2010, six pages.
Inlay Product World, Inc., Welcome to Inlay Product World, Inc., website, www.inlays.com, printed May 10, 2011, two pages.
Luthiers Mercantile International, Inc., Wood, Tools & Supplies, website, www.lmii.com, printed May 10, 2011, six pages.
Gurian Instruments, Marquetry Inlay and Wood Strips, website, www.gurianinstruments.com/showcase/musical-instrument-parts-and-manufacturing . . . , printed May 10, 2011, four pages.
Karin Rost, wooden inlays, website, http://karin-rost.com/eng/inhalt.htm, printed May 10, 2011, two pages.

* cited by examiner

*Primary Examiner* — Kimberly Lockett
(74) *Attorney, Agent, or Firm* — Thomas D. Wilhelm; Wilhelm Law, S.C.

(57) ABSTRACT

Decorative strip inlay products. Strip inlay products are used at the outer edges of stringed instruments, about the sound aperture and inwardly of the edges. Products of the invention are laser cut in the top surface of a workpiece. A bottom portion of the workpiece supports overlying cut portions. Where the strip must be flexed for insertion into curved channels, a substrate layer is resiliently flexible, and the overlying display layer is cut into segments, with spaces between the segments. The segments can move relative to each other, and/or flex, when the substrate flexes. Alternatively, the uncut bottom portion of the strip is rigid relative to an axis perpendicular to the top, and cavities in the display pattern are filled with filler and the resultant product, is sanded, resulting in display of both the filler material and the full pattern of the facing material as cut by the laser.

30 Claims, 10 Drawing Sheets

STRIP INLAY PRODUCTS, AND METHODS OF MAKING

BACKGROUND OF THE INVENTION

This invention relates to strip inlay products which are mounted in shallow elongate channels in generally continuous substrates. Typical substrates are wood, but such inlays can also be used with plastic metal, and other substrates. Inlay products are used to add decorative features to a wide variety of products, including stringed instruments, furniture, flooring, walls, and the like. Inlay products can also be used to decorate a wide variety of consumer products including electronics.

The invention is described in detail herein with respect to implementations in stringed instruments, with the understanding that the same principles can be used in applying the invention to other products such as, without limitation, those mentioned above.

The substrates in e.g. stringed musical instruments are typically quite thin, such as no more than 0.10 inch thick. The depth of the channel is sufficiently shallow to not penetrate the entirety of the thickness of the substrate. At the same time, the thickness of the substrate may be driven by considerations other than the strip inlay product. For example, in stringed musical instruments, the thickness of the substrate may be driven by the influence of the substrate thickness on tonal or other characteristic of the music produced by the instrument. In addition, the inlay product, itself, may have some affect on the characteristic of the music produced by the instrument.

Thus, the dimensions of the inlay product may be somewhat guided by the requirements of the instrument or other substrate while also being somewhat guided by the appearance benefits of the inlay product. Namely, the thickness of the inlay product must be thin enough to be received within the thickness of the substrate, and the width and length of the inlay product must be great enough to have the desired pleasing appearance affect.

The use of conventional strip inlay products has historically been limited by the nature of the decorative inlay products which are available. In general, such strip inlay products are made by (i) fabricating one or more, optionally several, inlay precursor wood laminates of differing wood species composition, typically differing by color, at respective locations in the laminate, and/or including vulcanized fiber substrate, (ii) slicing thin sheets from the respective wood laminates, across the laminate structure, so as to expose end grain surfaces of the wood and thereby capture, in each such sheet, the color variation represented by the various wood species end grains in the respective laminate, and (iii) optionally, gluing multiple ones of such sliced sheets together to make an inlay product having a mosaic or like pattern.

Thus, the conventional method of fabricating high quality purfling inlay products is a form of marquetry, wherein the structure of any portion of the display surface of the inlay extends from the visible displayed top surface of the inlay product through the entirety of the thickness of the inlay product, to the bottom surface of the inlay.

Such conventional wood inlay products are typically fabricated using e.g. vulcanized fiber substrate and/or a variety of species of wood to create a pleasing color arrangement in the finished inlay product.

Such inlay products are typically fabricated and marketed as straight-line strip inlay products. Where such straight-line strip inlay products are to be inlayed into a channel, such as along the curved edge of the box of a stringed instrument, for example in a guitar, the inlay product is known as purfling. Where such straight-line strip inlay product is to be inlayed into a channel away from the curved edge of the sound box, the inlay product is known as an inlay strip.

Where the channel into which the straight-line strip inlay product is to be mounted is curved, the strip inlay product must be flexed into the shape of the channel curves in order to fit into the curved channel. But the wood in the strip inlay product makes the strip inlay product quite rigid and resistant to flexing. It is not uncommon for the wood assembly of the straight-line strip inlay product to be broken while being flexed. Recognizing the need for such flexing, the manufacturers of such wood strip inlay product suggest heating the product to soften the product in order to facilitate such flexing. While heating provides some improvement in the ability to flex the straight-line strip inlay product, the industry still experiences substantial loss due to breakage of such wood inlay products during the attempted flexing step.

It is also known to apply humidity and/or other moisture to the strip inlay product in order to soften the wood and thus further facilitate the flexing/bending step. However, in spite of the use of such procedures to avoid breakage, the industry still experiences a substantial amount of breakage of such wood strip inlay products during the process of flexing/bending the product in preparation for, or in the process of, installing the strip inlay product into a curved channel. Some users flex/bend the strip inlay product in the process of installing the strip inlay product into the channel, whereby the breakage occurs at or proximate the channel such that a length of a strip which has been broken, but where the pieces have not separated substantially from each other, can be inserted into the channel with limited visible evidence of the break. Such breakage may be subsequently concealed or camouflaged by fillers, sawdust, or the like during the process of providing the overall surface finish on the resulting e.g. instrument of other product by sanding, filling, varnishing, and the like.

Given that purfling may be provided as a value-added feature in such products, there is an accompanying expectation that the value-added feature will be perceived by the customer as providing a higher quality product. Thus, the quality of the inlay strip is desirably as high as possible, and breakage, even where skillfully concealed or camouflaged, is not perceived as providing a high quality product.

While there is substantial use of such wood purfling strips in curved channels, the industry continues to struggle with breakage of the purfling strips in such applications. In any event, uses of curved purfling inlay products are limited to purfling inlay products having visualizable widths, after installation, of no greater than about ⅛ inch. While purfling strips of greater widths are available, and are desirable for the benefits of the enhanced visualization surface area, such greater-width purflings cannot be bent to any significant degree about an axis perpendicular to the top of the inlay, and are thus not used in curved channels in a flat plate such as the top or bottom plate.

As an alternative to straight strips of wood purfling, it is known to cut curved purfling strips from a wood substrate using e.g. a laser cutter. But each such curved purfling strip has a given curvature pattern which is designed/adapted for use only in a channel having the same curvature pattern. Thus, in fabricating curved wood purfling strips for the curved outer perimeter of the top plate of a guitar box, a separate curved purfling inlay strip is engineered and created for each length increment along the perimeter of the guitar. Accordingly, much hand labor and skill is required in designing and creating each such length of curved purfling inlay product.

As an alternative to wood purfling, it is known, as in U.S. Pat. No. 5,776,581 Sifel et al, to cut thin pieces of shell material from organic e.g. seashells, to laminate such pieces to each other to make laminated sheets, and to reduce the thickness of such laminated sheets to a thin dimension which is compatible with a limited degree of flexing of the laminated sheet structure about an axis which is perpendicular to a side edge of the strip but not about an axis which is perpendicular to the top of the strip product. Thin decorative strips are cut from the laminated sheet material. The resulting strips exhibit no useful flexibility.

The purpose of such shell inlay strips is typically to present a substantial size surface of the resultant strip for visualization on the surface of the instrument.

While the resulting shell inlay strips can, to a limited extent, be flexed in the first direction, namely the thinner dimension of the resultant strip, in order for the decorative purpose of the strip to be provided, the relatively larger surface of the strip is desirably presented for visualization in the top plate of the instrument sound box. And such larger surface can be presented for visualization by forcing the strip into the channel with the larger surface of the strip facing outwardly, allowing the strip to fracture/break in the process of inserting the strip into the channel, confining as possible, the broken ends so as to keep the ends in close contact with each other, and then concealing the broken ends of the strip during the process of finishing the outer (e.g. top) surface of the instrument. This process succeeds to an extent so long as the ends can be kept close to each other and closely lined up with each other. However, where breakage is accompanied by shell material completely separating from the strip, the resulting ends may not closely line up with each other, resulting in a further visual defect in the product.

As yet another option, curved strips or other non-straight-line-shaped product may be cut from the laminated shell sheet, where the curvature/shape of each piece is configured to fit into a correspondingly configured channel in the substrate to which the strip is to be mounted.

Examples of currently available purfling products are shown in Catalog 1010 of Luthier's Mercantile International, Inc., Windsor, Calif.

It would be desirable to provide a strip inlay product which can be flexed at will into whatever curved shape is expressed by the sound box without compromising the integrity of the purfling structure.

In light of the substantial amount of detailed hand labor involved in making conventional strip inlay product structures, it would also be desirable to provide more cost effective methods of making strip inlay product structures, such that such strip inlay product structures can be produced by automated methods.

It would be further desirable to provide cost effective methods of making flexible strip purfling structures wherein the strip purfling structure can be readily and reliably bent/flexed about an axis perpendicular to a side edge of the strip, to fit into curved receptacle channels following the curved outer perimeter of otherwise-conventional sound boxes of stringed instruments.

It would be still further desirable to provide straight-line inlay strip products wider than ⅛ inch, e.g. up to about 0.3 inch or more, which can be readily and reliably bent/flexed to fit into curved receptacle channels.

It would also be desirable to provide strip inlay products, such as purfling products, which have design options beyond those offered by marquetry laminations such as words and other designs not readily made by marquetry or other lamination techniques.

It would be still further desirable to provide methods of fabricating strip inlay products, such as purfling products, which provide additional design options, beyond marquetry, which use lesser amounts of hand labor, and which avoid certain assembly problems.

In addition to thin strip inlay products, it is also known to inlay a rosette or other decorative border, which is typically greater than 0.25 inch wide and up to about 1 inch wide, about the sound aperture(s) in a stringed instrument. For example, circular rosette rings are known to be inlayed about the sound aperture of a guitar.

A relatively simple circular rosette ring inlay product is a thin veneer of wood, cut in a pattern whose inner perimeter reflects the perimeter of the sound aperture about which the rosette is to be mounted.

More complex rosettes are fabricated, again by marquetry, from wood, using laminates which display the end grain of the wood laminates, similar to the laminates used in wood strip purfling inlay products. In fabricating a series of rosettes, first a series of laminates are made, and adhered to each other edge to edge to fabricate an elongate log representation of the circular or other shape of the desired rosettes. Very short lengths of the edge-adhered laminates are cut from the elongate log structure so as to express the end grain of the wood across the cut surface, thus making multiple rosette products, each expressing the same visualization pattern, from each such rosette log.

In the alternative, the elongate log may represent only a portion of the circular ring shape, and the pieces cut from the log are subsequently assembled to each other, edge to edge, in fabricating the rosette.

As with strip purfling inlay products, the fabrication of a rosette-type inlay product uses substantial hand labor in the assembly of the various laminate strips to each other, as well as in the assembly of the log. As with purfling strip inlay products, a channel is cut in the top plate of the instrument, namely about the perimeter of the sound aperture, and the rosette product is in-laid into the channel.

Thus, it would be desirable to provide rosette inlay products which can be fabricated using limited hand labor.

It would be further desirable to provide rosette inlay products which have design options beyond those offered by marquetry laminations.

It would be still further desirable to provide methods of fabricating rosette inlay products which provide additional design options, which use lesser amounts of hand labor, and which avoid certain assembly problems.

These and other needs are alleviated, or at least attenuated, by the novel products and methods of the invention.

SUMMARY OF THE INVENTION

This invention includes decorative strip inlay products such as are commonly used in decorating stringed instruments during fabrication of such stringed instruments. Referring, for example, to use of such decorative strips on a guitar, such strip inlay products may be mounted at the outer edges in the top plate, about the sound aperture in the top plate, in the side plate, and/or in the bottom plate. Such strip inlay products may also be mounted in the neck and/or head. Namely, such strip inlay products are mounted almost anywhere in the outer surface of the body of the instrument, depending on the perceived value to the customer. Strip inlay products of the invention comprehend laser cutting a pattern in the top surface of a workpiece and supporting the cut portions with an uncut bottom portion of the workpiece. The supporting bottom portion may be an uncut portion of the layer which was cut, or may be a separate layer mounted to the bottom of the layer which was cut.

Where the strip inlay product is desired to be useful over a range of curvatures of channels into which such strip products are mounted, the substrate layer is a resiliently flexible e.g. elastomer, and the overlying display layer is cut into discrete segments, with spaces between the segments, such that the individual segments can move relative to each other, and/or flex, so as to accommodate flexing of the substrate material relative to the curvature of the channel, and to fit the segments into the channel.

In the alternative, the uncut bottom portion of the strip inlay product is generally rigid relative to an axis perpendicular to the top of the product, and the cavities between the respective portions of the display pattern are filled with fluid or paste-consistency filler material and the resultant product, when hardened, is sanded, resulting in display of both the filler material and the full pattern of the facing material as cut by the laser.

In a first family of embodiments, the invention comprehends an elongate decorative strip inlay product having a top, a bottom, opposing first and second sides between the top and the bottom, a length, a width of about 0.03 inch to about 1.5 inches between the first and second sides, and a thickness of about 0.03 inch to about 0.4 inch between the top and the bottom. The elongate decorative strip inlay product comprises a flexible, relatively underlying, layer of substrate material extending the length and width of the elongate decorative strip inlay product; and a relatively overlying layer of display material, affixed to the substrate layer, wherein a such elongate decorative strip inlay product, which is straight when in a relaxed condition, is sufficiently flexible that the elongate decorative strip inlay product can be flexed, about a vertical axis which is perpendicular to the top and bottom of the decorative strip inlay product, to a curvature representing a radius of no more than 5 inches.

In some embodiments the overlying layer comprises a plurality of display material segments, separate and distinct from each other, and unoccupied spaces between respective ones of the material segments, such that ones of the display material segments can move relative to each other in accommodation of such flexing of the strip inlay product.

In some embodiments, ones of the display material segments are substantially less flexible, in such direction of flexing, than the substrate material.

In some embodiments, the display material comprises a plurality of segments of the display material extending, side-by-side, along the length of the inlay product, at least one segment of the display material having a width, along a portion of the segment, substantially less than the width of the strip inlay product, and wherein the at least one segment can flex in accommodating such flexing of the strip inlay product.

In some embodiments, the plurality of side-by-side segments can collectively flex in accommodating the flexing of the strip inlay product.

In some embodiments, the composition of the display material is selected from the group consisting of wood, bamboo, bone, ivory, polymer, stone veneer, faux stone, metal, and organic shell.

In some embodiments, the substrate material comprises elastomeric material.

In some embodiments, the substrate material comprises a composition selected from the group consisting of natural rubber and synthetic rubber.

In some embodiments, the substrate layer is about 0.025 inch thick to about 0.06 inch thick.

In some embodiments, the substrate layer has a hardness of about 25 to about 75 on the Shore A scale.

In some embodiments, the substrate layer comprises synthetic rubber about 0.02 inch thick to about 0.04 inch thick, having a hardness of about 35 to about 65 on the Shore A scale, and wherein the overlying layer comprises a plurality of display material segments having hardnesses greater than 75 on the Shore A scale, which display material segments can move relative to each other in accommodating such flexing of the strip inlay product.

In some embodiments, the substrate layer has a hardness of about 25 to about 75 on the Shore A scale, and the strip inlay product has an average width of about 0.03 inch to about 1 inch, optionally the substrate layer has a hardness of about 35 to about 65 on the Shore A scale, and the strip inlay product has an average width of about 0.06 inch to about 0.75 inch.

In some embodiments, the invention comprehends a stringed instrument comprising an elongate such strip decorative inlay product, received in a curved channel at an edge of a visible layer of the stringed instrument.

In some embodiments of such instrument, the overlying layer comprises a plurality of display segments, distinct from each other, and spaces between respective ones of the display material segments, and filler material in the spaces between the display material segments, the filler material and the channel each precluding subsequent flexing of the elongate inlay product.

In a second family of embodiments, the invention comprehends a method of making an elongate decorative strip inlay product having a top, a bottom, opposing first and second sides between the top and the bottom, a first length, a first width of about 0.03 inch to about 1.5 inches between the first and second sides and transverse to the length, and a thickness of about 0.03 inch to about 0.4 inch between the top and the bottom. The method comprises providing a backing board; mounting a multiple-layer sheet structure on the backing board to create an inlay workpiece, the multiple layer sheet structure comprising a flexible, relatively underlying, layer of substrate material having a second length, and a second width greater than the first width, and a relatively overlying layer of display material, affixed in the multiple layer sheet material, the overlying layer having a top and a bottom, a third length, and a third width greater than the first width; cutting the overlying layer, from the top to the bottom of the overlying layer so as to create discrete display material segments, separate and distinct from each other along a plurality of discrete lines of such segments, thereby separating the display material segments in a first line from the display material segments in adjacent lines; cutting through the substrate material between respective ones of the discrete lines thereby to separate individual purfling or other decorative strips from the blank and from each other; and separating individual ones of the decorative strips from the backing board.

In some embodiments, the cutting of the overlying layer so as to create distinct segments separates the display material in a given such line into distinct segments wherein the segments in such first line are separated from each other and/or so as to separate the display material in a given such line into distinct segments spaced from each other longitudinally along the length of the given line.

In a third family of embodiments, the invention comprehends a decorative strip inlay product having a top, a bottom, opposing first and second elongate sides extending between the top and the bottom, the first side having a first length and the second side having a second length, a width of about ¼ inch to about 1 inch between the first and second sides, and a thickness of about 0.03 inch to about 0.4 inch between the top and the bottom, the decorative strip inlay product comprising a first dam at the first side of the decorative strip, and extending along the full length of the first side; a second dam at the second side of the decorative strip, and extending the full length of the second side; a display pattern of face material between the first and second dams and extending downwardly from the top of the strip inlay product; and one or more cavities defined between respective portions of the display pattern of face material and/or between respective portions of the display pattern of face material and one or more of the first and second dams, the first and second dams and the face material expressing properties which reflect the dams and at least a portion of the face material having been derived from a common work piece.

In some embodiments, the dams and the at least a portion of the face material are wood, and have a common grain direction and a common species.

In some embodiments, the strip inlay product further comprises a thin sheet substrate underlying, and attached to, the dams and the face material.

In some embodiments, the invention further comprises one or more filler materials filling the cavities.

In a fourth family of embodiments, the invention comprehends a method of fabricating a decorative strip inlay product having a top and a bottom, opposing first and second elongate sides extending between the top and the bottom, the first side having a first length and the second side having a second length, a width between the first and second sides, and a thickness between the top and the bottom. The method comprises selecting a suitable substrate workpiece within which the decorative strip inlay product can be fabricated; releasably mounting the selected workpiece on a backing board to make a workpiece assembly having a top and a bottom, a top of the substrate workpiece being defined by face material and corresponding with the top of the workpiece assembly, a bottom of the substrate workpiece facing a top of the rigid backing board; mounting the workpiece assembly in a laser cutting machine so as to apply cutting energy at the top surface of the workpiece assembly; applying the laser cutting machine at the top of the workpiece assembly and thereby cutting through the workpiece assembly from the top of the substrate workpiece to the bottom of the substrate workpiece, and thereby defining first and second elongate sides of the decorative strip, cut entirely through the substrate workpiece and thereby severing waste material of the substrate workpiece from the remainder of the substrate workpiece; and cutting into and not through the substrate workpiece between the first and second elongate sides and thereby creating a first dam at the first side of the decorative strip and extending along the full length of the first side, a second dam at the second side of the decorative strip and extending along the full length of the second side, a display pattern of uncut portions of the face material between the first and second dams, and one or more cavities defined between respective portions of the display pattern and/or between respective portions of the display pattern and one or more of the first and second dams; removing the severed waste material from the workpiece assembly, thereby leaving on the backing board a precursor of the decorative strip inlay product; filling the cavities with one or more filler materials; and sanding the top of the resultant product precursor, resulting in display of both the filler material and the full pattern of the facing material as cut by the laser cutter, and producing the decorative inlay strip product.

In some embodiments, the method further comprises applying a sealer to the top surface of the decorative inlay strip product.

In some embodiments, the method further comprises removing the decorative strip product from the backing board after applying the sealer.

In some embodiments, the method further comprises removing the decorative strip product from the backing board, and subsequently applying the sealer to the decorative strip product as a stand-alone strip product.

In some embodiments, the strip product is a closed-strip configuration.

In some embodiments, the strip product is an open-strip configuration having at least a first end extending between the first and second sides, and further comprising a third dam connecting the first and second sides at the first end.

In some embodiments, the substrate workpiece comprises a first relatively overlying display layer, and a second relatively underlying thin sheet affixed to the overlying display layer, the underlying thin sheet optionally comprising a vulcanized fiber substrate comprising at least partially regenerated cellulose fibers.

Figure 1:
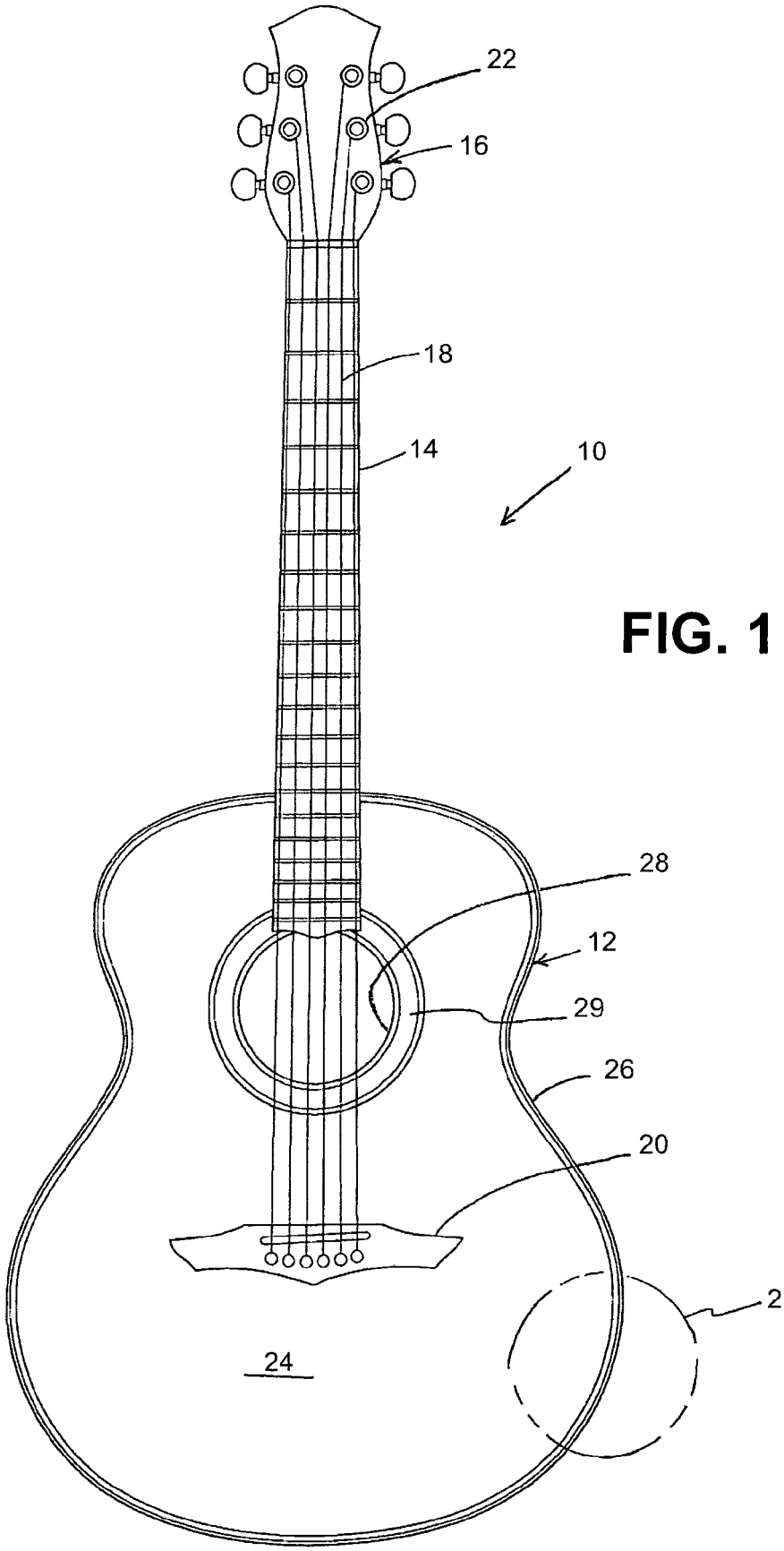
FIG. 1 shows a front view of a guitar.

The invention is not limited in its application to the details of construction, or to the arrangement of the components set forth in the following description or illustrated in the drawings. The invention is capable of other embodiments or of being practiced or carried out in various other ways. Also, it is to be understood that the terminology and phraseology employed herein is for purpose of description and illustration and should not be regarded as limiting. Like reference numerals are used to indicate like components.

DETAILED DESCRIPTION OF THE ILLUSTRATED EMBODIMENTS

Figure 2:
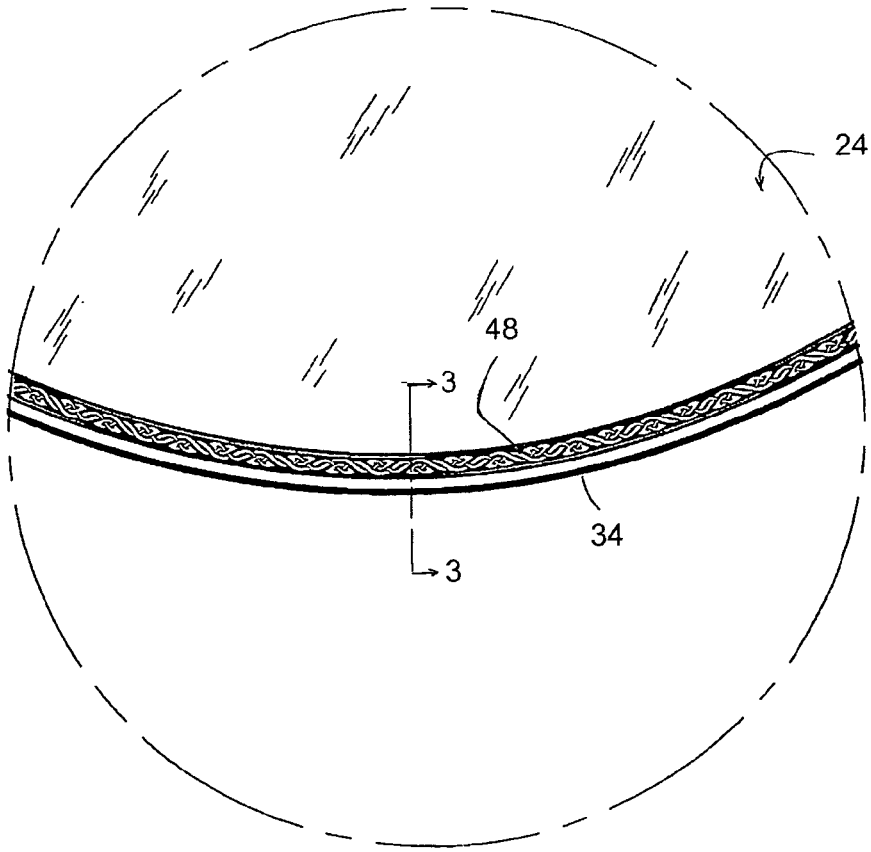
FIG. 2 is an enlarged view of a portion of an edge of the top plate of the guitar of FIG. 1, showing the edge puffing, and taken at circle 2 in FIG. 1.
Figure 3:
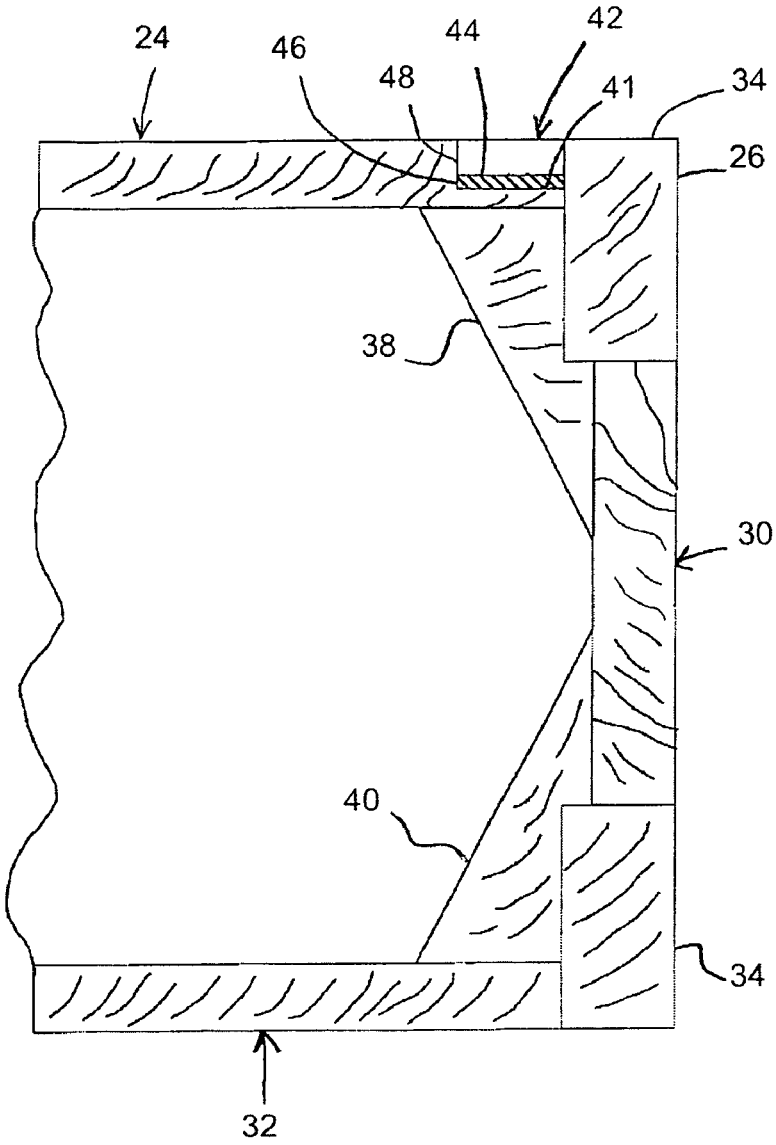
FIG. 3 is a cross-section of one side of the guitar sound box, taken at 3-3 of FIG. 2.

Referring to the drawings, FIG. 1 shows a top view of a guitar 10. The guitar of FIG. 1 illustrates a sound box 12, a neck, 14, a head 16, and a plurality of strings 18 extending from a bridge 20 to mounting studs 22 on the head. FIGS. 2 and 3 show the edge of the guitar of FIG. 1 in more detail.

Referring now to FIGS. 1, 2, and 3, a top plate 24 on the sound box has an outer edge 26, an inwardly-disposed sound aperture 28, and a rosette ring 29 extending about the sound aperture. The sound box 12 is further defined by a side plate 30, and a bottom plate 32. Side plate 30 extends between top plate 24 and bottom plate 32. Edge bindings 34 are positioned at edges of the side plate, the top plate, and the bottom plate, at the top and bottom edges of the sound box. The edge of the sound box adjacent the top plate is underlain by, and supported by, top edge lining 38. The edge of the sound box adjacent the bottom plate is underlain by, and supported by, bottom edge lining 40.

In FIG. 3, a channel 41 is illustrated disposed inwardly of the edge binding on the top plate. A strip of decorative purfling inlay product 42 is received in, mounted in, channel 41. A horizontal dashed line 44 in FIG. 3 indicates generally the boundary between a purfling substrate layer 46 and an overlying display layer 48. FIG. 2 illustrates a first embodiment of a pattern of the overlying display layer 48 as viewed from a direction perpendicular to the top plate of the guitar.

Figure 4:
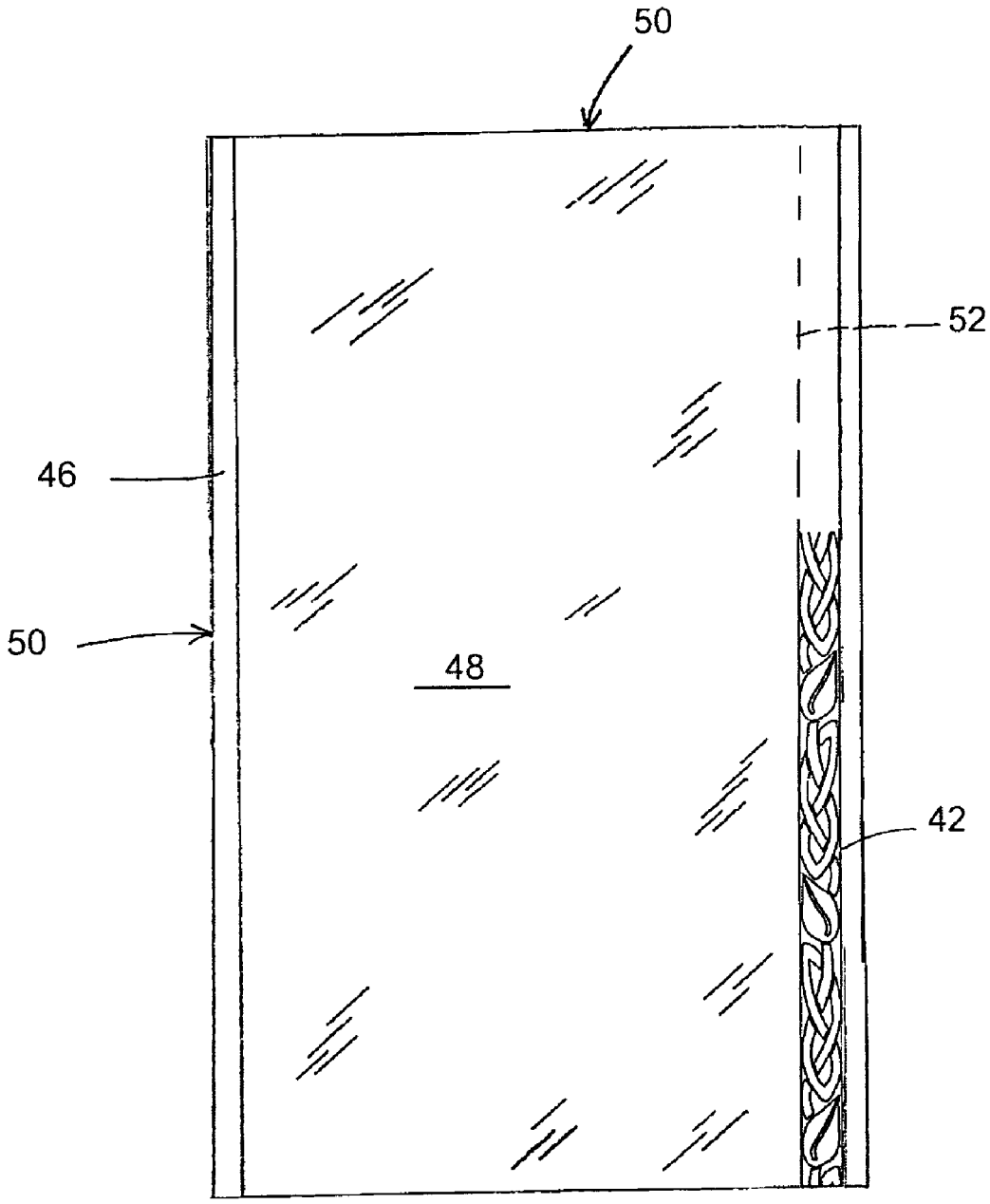
FIG. 4 shows a top view of a blank from which a plurality of purfling strips can be patterned/fabricated, and then cut as individual purfling strip inlay products, with the cutting of the pattern in a first such strip having been initiated.

FIG. 4 shows a purfling blank 50. Blank 50 has an underlying layer which represents substrate layer 46 in the ultimately fabricated purfling strip inlay products; and an overlying sheet which represents the display layer 48 in the ultimately fabricated purfling strip inlay products. The display layer can be, for example, a sheet of wood veneer. The width of the substrate layer extends beyond the width of the display layer as illustrated at 46 in FIG. 4.

In FIG. 4, a first purfling strip 42 is illustrated as being partially inscribed, cut, in the display layer, expressing a second embodiment of a pattern/design, different from the pattern/design cut into the display layer in FIG. 2. Dashed line 52 in FIG. 4 shows a straight line projection which represents the left side edge 54 of the partially inscribed purfling strip, illustrating the forthcoming continuation of the cutting of the left edge of the purfling strip, both in inscribing the purfling pattern in the display layer and in further cutting through the substrate layer in the process of separating the individual purfling strip inlay product from the remainder portion of the blank. The left side edge 54, and corresponding right side edge 56, of the purfling strip, which are formed by such cutting, are better seen in FIG. 6. A plurality of purfling strips can be fabricated, side-by-side, in such blank as illustrated in part in FIG. 4, before any such purfling strip inlay product is separated from the blank, and the respective purfling strip inlay products can subsequently be separated from the so-fabricated blank.

Figure 5:
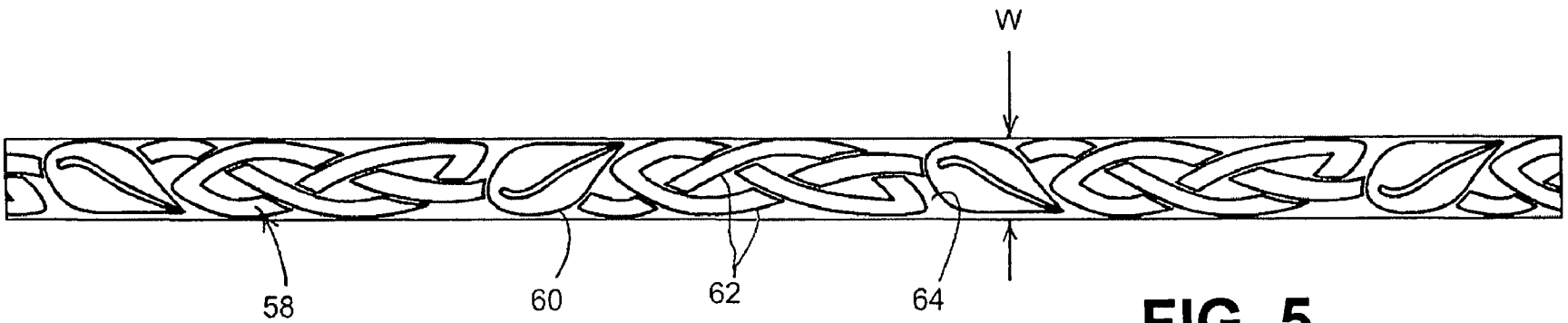
FIG. 5 is a top view of a second embodiment of the display surface of a purfling strip of the invention, showing the flexible purfling strip before such purfling strip is assembled to a substrate.

FIG. 5 is a pictorial view of a purfling strip inlay product 42 expressing the second pattern in the overlying display layer, after the fabrication of the purfling strip as in FIG. 4 has been completed and the purfling strip inlay product has been cut from the structure of blank 50.

Figure 6:
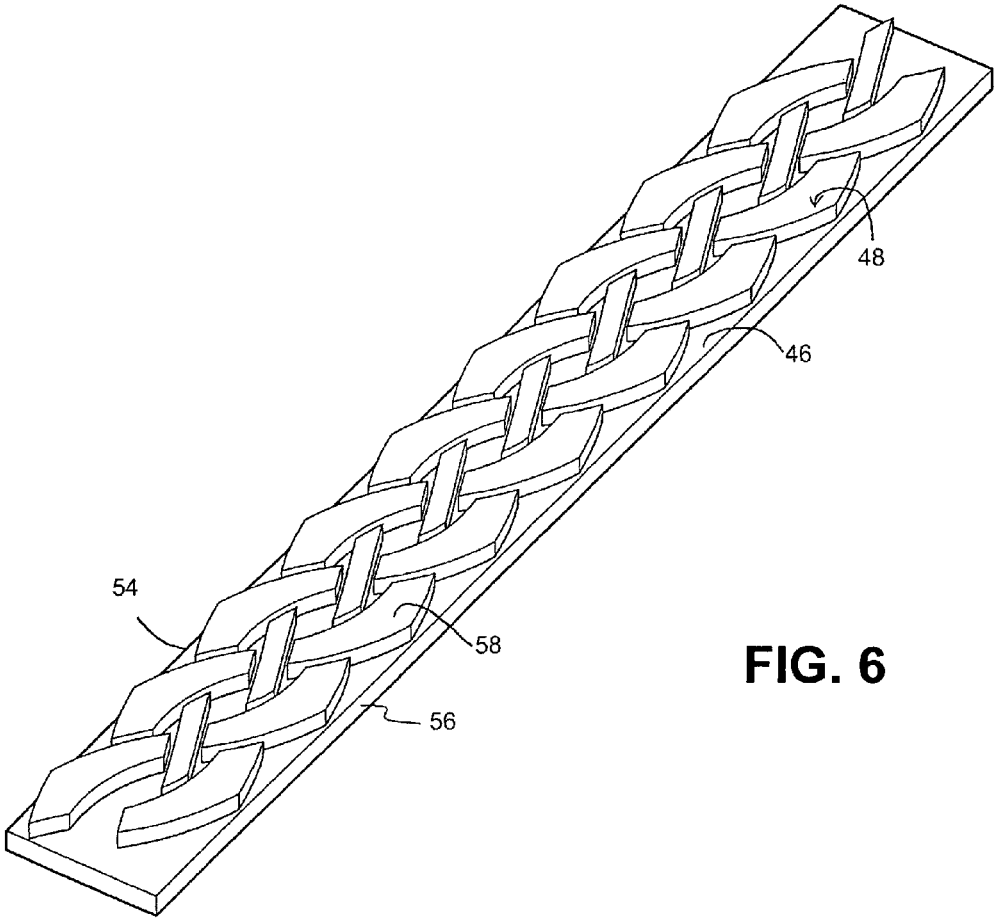
FIG. 6 is a pictorial view of a third embodiment of the display surface of a purfling strip of the invention, showing the underlying flexible substrate material layer, and discrete segments of the overlying display material layer.

FIG. 6 shows a pictorial view of a purfling strip having yet a third embodiment of a pattern in the display layer, after waste material has been cut away from the display layer, and the strip inlay product has been severed from the blank structure.

Referring now to the purfling structure in more detail, and as illustrated in FIG. 6, a resiliently flexible material is used for substrate layer 46. A wide range of such materials can be selected from among, without limitation, materials such as natural and synthetic polymers, sometimes referred to as elastomers.

As used herein, an "elastomer" is a polymer having substantial elongation, including the property of elasticity, generally having relatively low Young's modulus and high yield strain compared with other materials, combined with the ability to be stretched substantially and return to its original shape when released from such stretching. As a result of this substantial flexibility and resilience, elastomers can, in general, be reversibly extended from about 200% to about 700%, depending on the specific material.

While choosing to not be bound by theory, elasticity in elastomers is believed to be derived from the ability of long polymer chains to reconfigure themselves to distribute an applied stress and/or to return to their original configuration when the applied stress is removed. An accompanying property of elongate strips of such materials is that they can be flexed to express a wide variety of shapes.

Consistent with the requirement that the substrate layer be quite flexible, a property characteristic of materials which meet such requirement is the hardness of the material, namely the ability of the material to tolerate being deformed without structural failure of the material. Hardness is commonly measured by a conventional and widely accepted test known as a "Shore Durometer Hardness" test. Materials found to be particularly desirable for use as substrate layer 46 typically have Shore Hardness of about 25 to about 75, both on the Shore A scale. A more typical hardness is about 35 to about 65, optionally about 45 to about 55, all on the Shore A scale.

Such materials are generally considered to be relatively soft. Also, the hardness of such materials is commonly expressed with a range of plus or minus about 5 units, thus to allow for variations in repeated tests as well as variations commonly encountered in such manufactured materials.

The substrate layer can have a thickness of about 0.015 inch to about 0.4 inch. More typical thickness is about 0.025 inch to about 0.1 inch, optionally about 0.02 inch to about 0.04 inch, thus maintaining a relatively thin profile such that the purfling strip can be mounted as an inlay in a channel in the parent product with limited disruption of the structural characteristics of the parent product material in creating the channel.

An exemplary such elastomer material, suitable for use as a substrate layer in flexible inlays of the invention, is a polychloroprene, also known as Neoprene, meeting MIL-R-6855 Class 2 Grade 50. A particularly desirable such Neoprene has a Shore Durometer Hardness of 50 plus or minus 5 on the Shore A scale. Such exemplary material also has a thickness of about 1/32 inch, tensile strength of about 1600 psi, and ultimate elongation of about 400 percent, all using standard ASTM tests.

A strip of such Neoprene, having a top, a bottom, a left side edge, a right side edge, a thickness between the top and the bottom, and a width of about 1/4 inch, can readily be flexed left or right along the length dimension, about an axis perpendicular to the top of the strip, to a curvature representing a radius of no more than 5 inches, optionally no more than 3 inches, and typically no more than 2 inches, optionally even less. A similar such strip, but ⅛ inch wide, can be flexed about a radius representing a curvature of no more than 1 inch. Thus, such material meets the flexibility properties desired for the purfling strip inlay product and thus is suitable for use as a substrate/carrier layer in flexible purfling strip inlay products of the invention.

Purfling strip inlay products are desired for their artistic, aesthetic display characteristics. Accordingly, a display layer is assembled, e.g. by use of adhesive, onto the substrate layer, to participate in expressing such artistic characteristics. In order for the purfling strip inlay product assembly to have the desired flexibility for installing the purfling strip inlay product around curves, such as at the edge of a guitar, the display layer, itself, must allow for the necessary flexing without damage to either the substrate layer, the display layer, or any other layer in the purfling strip inlay product structure.

Referring to FIGS. 2, 4, 5, and 6, display layer 48 is made up of a plurality of display layer segments 58 which are discontinuous along the length of the purfling strip. FIG. 5 shows a leaf 60 which extends essentially the full width of the purfling strip. Assuming the display material is not flexible/elastomeric, the segment must be sized to accommodate flexing of the underlying substrate along with placement of the full length and width of the segment into the underlying so-curved channel 41.

The effective length and width characteristics of non-flexing segments of the display material are thus governed entirely by the ability to fit all such segments into the channel curvature. A segment design having both wider and narrower segments, such as a stem 62, or segments having both relatively wider portions and relatively narrower portions, is generally more constrained by wider segments, or portions of segments, than by relatively narrower segments or relatively narrower portions of the segments, recognizing that the ability to conform the overall segment to the channel path is the ultimate discriminator of the suitability of a given purfling strip design.

By contrast, where the segment 58 is flexible enough to flex about the channel curvature, no such length/width constraint is necessary so long as the flexed, as necessary, width of the segment, and strip, can be fit into the channel.

Where the segment material is generally inflexible, as in a wood display layer, but the segment is thin enough, and the length of the segment extends in a direction where a grain, e.g. wood grain, supports some flexing without breakage, such as along the length of the grain of the wood, and wherein the length of the segment extends along the length of the purfling strip, then the flexibility of the segment which is largely a function of the dimensional characteristics of the segment, allows the maximum length and width dimensions of the segments, relative to length and width of the purfling strip, to be designed in accord with the available flex properties of the elongate thin strip of e.g. wood material. Accordingly, where the length of the strip extends with the grain of the wood, not across the grain, a wood display material segment can have substantial flexing capacity, whereby the maximum allowable length/width ratio is a function of the wood species and the width and thickness of the segment.

Where the display material does not flex regardless of any desirable width of the display material segment, then the display material segments must be sized, configured such that each such segment can fit within the curved or other lines of the purfling channel 41 without flexing of the individual display material segments to affect such fitting.

Thus, the maximum length and/or width of a given segment is affected by at least the following factors:

1. A non-flexing segment must fit within the purfling channel without reconfiguration/flexing of the segment, whereby the maximum length and/or width is/are controlled by the radius of curvature of the purfling strip channel and the width dimensions of the segment.
2. A segment which has a relatively limited flex capacity, such as results from a thin width configuration, can have a length/width combination greater than that represented by a straight line in the respective length of the channel and modified by the flex capacity of the segment, so long as the cumulative widths of any side-by-side segments in a given length of the channel can flex about the respective curvature, while remaining within the width of the channel.
3. Where the segment has a relatively substantial inherent flex capacity, derived from the physical properties of the segment material, the length can, in some instances, be unlimited, because the segment material can be deformed/flexed/bent to a configuration which can fit the curvature of the channel.

Another factor in the display layer design is that relatively inflexible segments, as cut in the blank, should be cut the full thickness of the display layer, and all the cut-away material should be removed from between the segments such that the segments are generally spaced from each other by spaces 64 which are large enough to be readily visible, and wherein filler material used to subsequently fill such spaces after the purfling strip is mounted in a channel on the instrument, is readily visible in the finished instrument. Given the spaces between such segments, the substrate material underlying such spaces can flex in accord with the flex properties of the substrate material, unencumbered by overlying display material since substantially all of the display material has been removed from the assembly above such spaces. Accordingly, as the purfling strip is flexed, the substrate material underlying such spaces is able to flex in accord with the properties of the substrate material, and the segments adjacent such spaces move relative to each other whereby the length and width dimensions of the spaces expand and/or shrink in accommodating the flexing of the underlying substrate.

The minimum spacing between segments is driven by at least the amount of curvature of the channel into which the purfling is to be installed, by the fraction of the width of the channel which is represented by the display segments, both individually and collectively, and by the flex capacities of the segments. Thus, where a segment, itself, has e.g. some, though limited, flex capacity, the spacing may not need to be as great as where a segment has no flex capacity at all.

The composition of the display layer can be any material which (i) can be obtained in a thickness which is compatible with the needed display layer thickness, as well as (ii) being suitable for fabrication into segments having the desired pattern which can be flexed as needed to fit into a channel 41. Thus, there can be mentioned, as non-limiting examples of material which can be used in the display layer 48, wood, bamboo, bone, ivory, stone veneer, faux stone, a variety of plastics, aluminum, titanium, copper, gold, platinum, palladium, rhodium, iridium, and other metals, abalone and other organic seashell materials, turquoise and a wide variety of other natural minerals as well as manufactured semi-precious stone materials.

Display layer materials commonly, but not necessarily, have hardness greater than 75 on the Shore A scale.

Thickness of the display layer material can be any thickness desired consistent with the material of the parent product, and corresponding channel, into which the purling strip is to be installed/incorporated. Thus, where the parent material is relatively thicker, the display layer can be relatively thicker, if desired. Where the parent material is relatively thinner, the display layer is designed to be relatively thinner. However, in many cases, the material from which the display layer is made is rather costly, whereby the thickness of the display layer is typically selected to be relatively thin to contain cost, while providing the desired aesthetic properties of the display layer. Another factor in specifying the thickness of the display layer is that the thickness of the respective material must be compatible with the cutting procedure contemplated for cutting away waste material of the display layer in fabricating the segments of the display layer.

Accordingly, while not limiting, the display layer is typically specified as quite thin, such as about 0.015 inch to about 0.10 inch, optionally about 0.02 inch to about 0.05 inch.

Given the flexibility of purfling strip inlay products of the invention, the previous limits on the width, of about ⅛ inch, of any purfling strip inlay product, which is to be flexed for mounting into a curved channel, are no longer needed, whereby the width of the purfling strip inlay product to be used in such curved channel can be greater such that the width of a purfling strip inlay product of the invention, to be used in such curved configuration, can be from as little as about 0.03 inch or smaller, as is conventional, to about 1.5 inch. And rather than the width being limited by the ability of the display material to flex, the width of purfling strips of the invention is limited only by the ability of the flexible substrate layer to flex, with the display layer segments, and the spaces between the segments, being designed for a given such flexing.

In addition to the additional flexibility of purfling strips of the invention, such purfling strips offer an essentially unlimited array of design options which are not available with known methods of making purfling strips. For example, the lengths of design elements can overlap each other longitudinally, namely along the length of the purfling strip. Filler material is used to fill the spaces in intervening cavities after the purfling strip is mounted in a channel 41. And such filler material between the segments of display material is readily visible to the naked eye.

Figure 7:
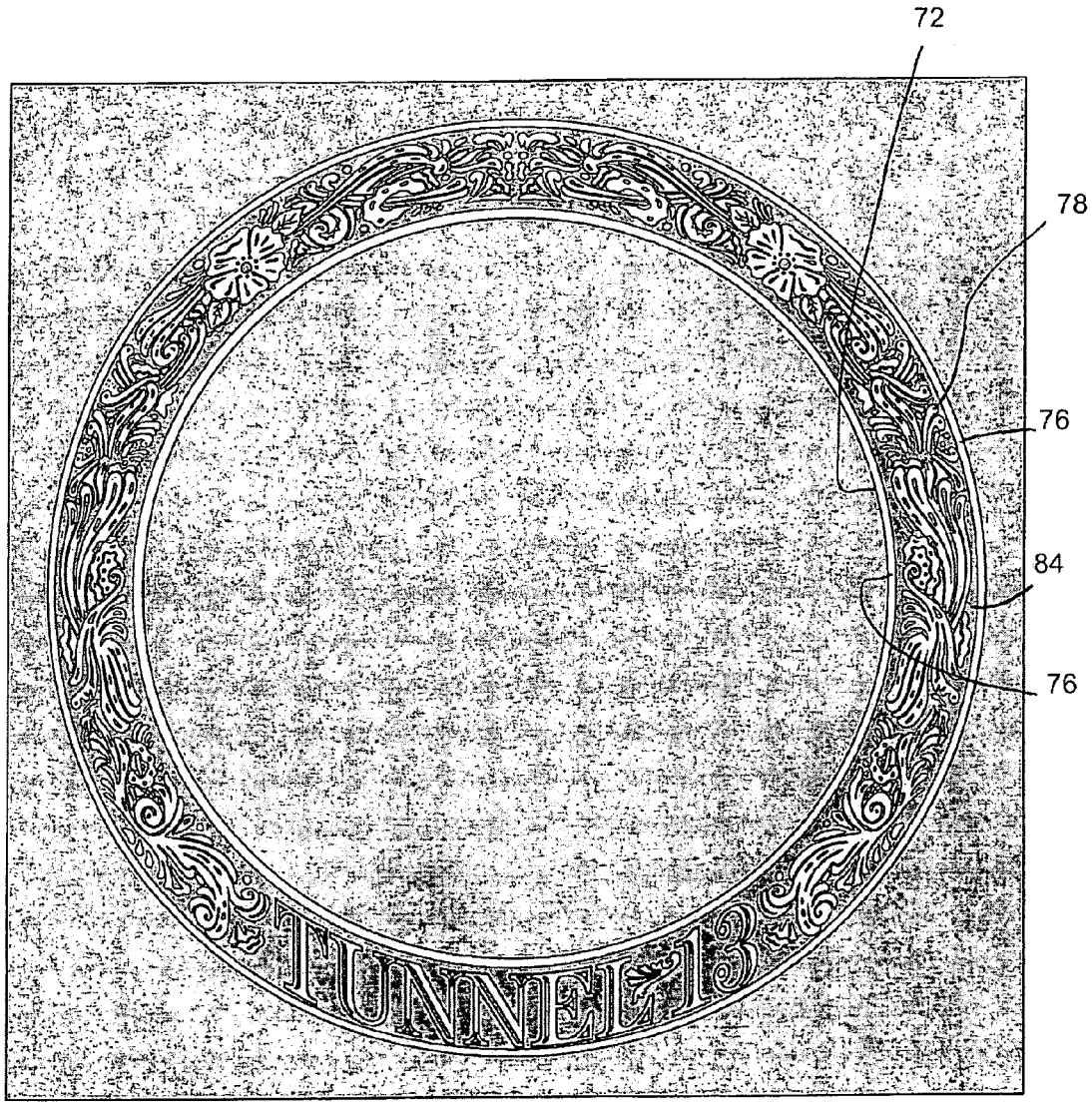
FIG. 7 is a top view of a rosette ring inlay product of the invention such as the rosette ring illustrated representationally, and substantially surrounding the sound aperture of the guitar, in FIG. 1.
Figure 9:
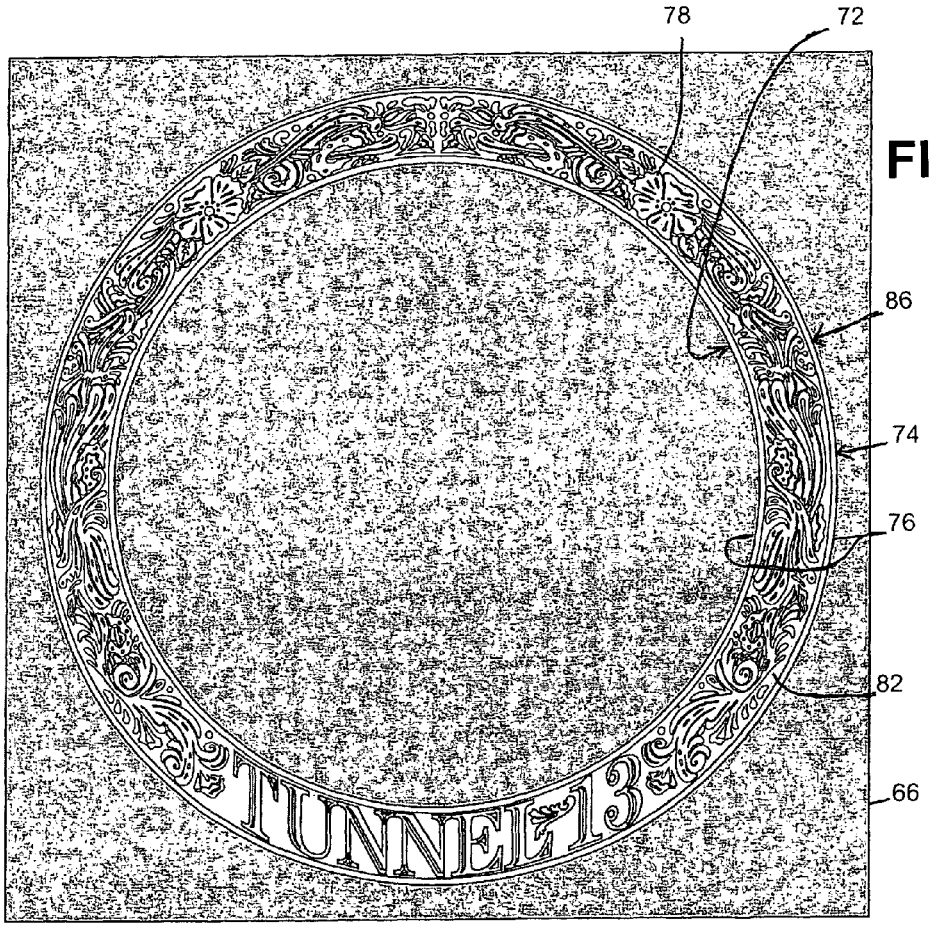
FIG. 9 is a top view of the rosette work piece of FIGS. 7-8, still mounted on the backing board, and after the pattern and dams have been cut in the rosette ring, and the waste material of the overlying layer, inside and outside the rosette ring, have been removed.
Figure 11:
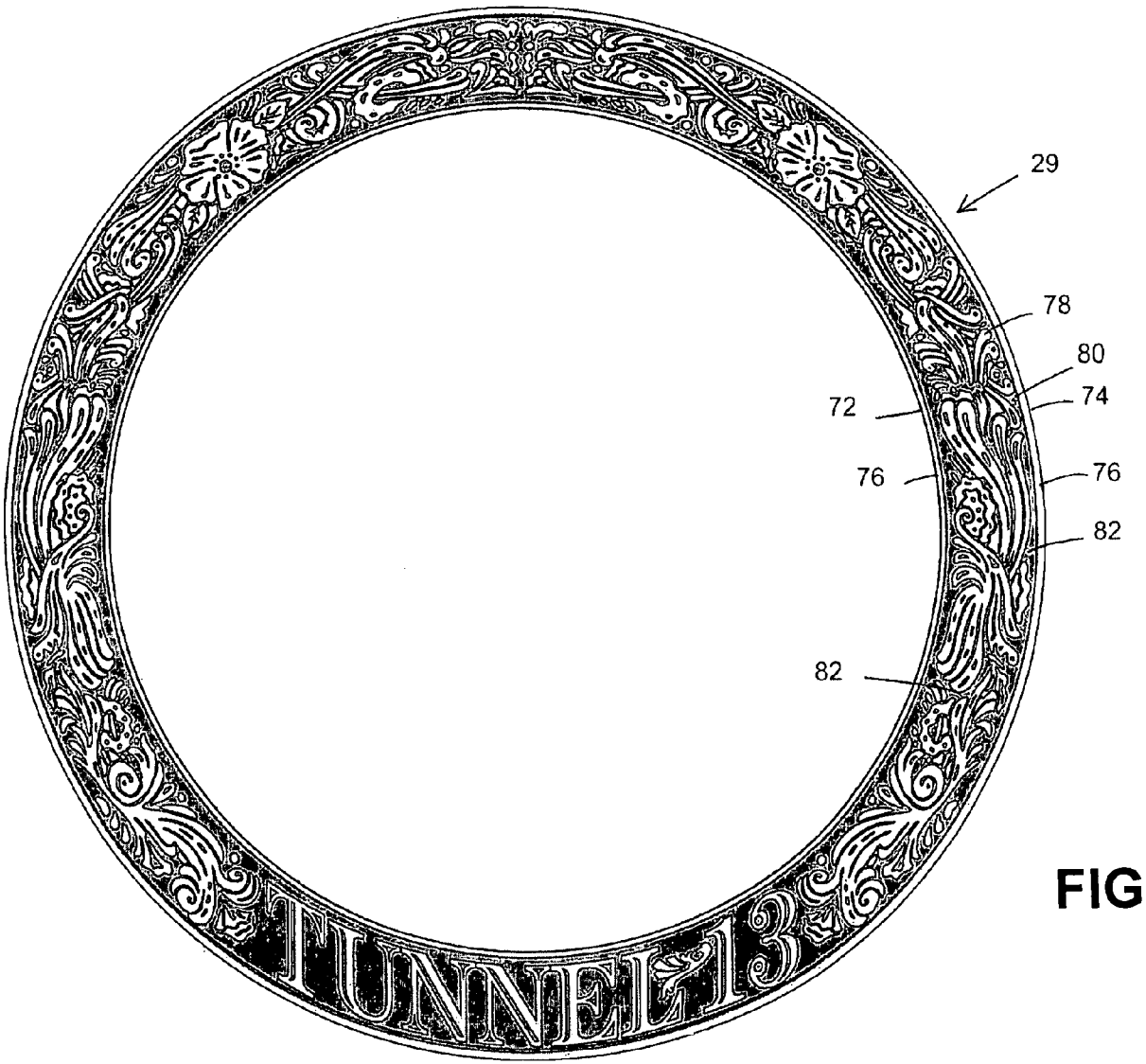
FIG. 11 is a top view of the work piece of FIGS. 9 and 10, after the workpiece has been removed from the backing board, and before the recesses in the pattern have been filled with filler material.

In addition, such design elements as numbers, letters, and any fanciful design, are now available, both alone and in combination, for example spaced along the length of the purfling material, with intervening filler material readily visible to the naked eye between the respective characters and/or elements so as to represent a string of numbers, a string of letters, or a combination of a string of letters and numbers, optionally in combination with fanciful display element imagery, all as illustrated in FIGS. 7, 9, and 11.

Example

A non-binding example of a purfling strip of the invention is made as follows. A blank from which purfling strips can be made was first assembled. In making the blank, a wood veneer display layer sheet 3 inches wide by 16 inches long was adhesively mounted to a substrate layer of Neoprene, meeting MIL-R-6855 Class 2 Grade 50 specifications. The grain of the wood extended along the length of the sheet of wood veneer. The substrate layer had a Shore Hardness of 50 plus or minus 5 on the Shore A scale, and a thickness of about 1/32 (0.031) inch. The substrate layer was 3.2 inches wide by 16 inches long. The display layer overlaid the entirety of the substrate layer lengthwise, and the width of the display layer was centered on the width of the substrate layer, all as illustrated in FIG. 4. FIG. 4 shows that the sides of the substrate layer extended beyond both sides of the veneer sheet. The veneer display layer sheet was about 0.022 inch thick. Thus, the overall thickness of the blank assembly was 0.053 inch.

Flexibility of the resulting blank assembly was controlled by the rigidity of the display layer of wood whereby the assembly could not be flexed about a vertical axis passing top-to-bottom through the blank assembly. Similarly, the assembly could not be stretched by pulling on the ends of the blank assembly. A limited amount of resilient flexing was possible about an axis passing through the width of the blank, perpendicular to the length of the blank and perpendicular to the grain of the wood. Attempts to flex the blank, substantially, about an axis extending along the length of the blank, which was in alignment with the grain of the wood, led to fracturing of the wood.

Using 2-sided pressure sensitive tape, an undamaged such blank was mounted to a rigid and flat backing board ⅛ inch thick to make an inlay workpiece. The backing board was a high-density fiberboard sometimes known as Masonite®. The so-mounted inlay workpiece was then mounted in a laser cutting machine driven by a programmable logic computer (PLC). The PLC was programmed with a suitable pattern of purfling strip designs to be cut along the length of the blank assembly, including power settings which would cut through the wood display layer but not through the substrate layer, whereby display patterns could be cut in a plurality of inlay strips while retaining the blank as a unitary whole until all such inlay strip patterns had been cut.

The laser cutting machine was then used to cut away wood material from the display layer, down the full depth of the display layer, but not through the substrate layer. FIG. 4 illustrates the blank assembly after the laser cutter has cut a first line of discrete segments, separate and distinct from each other, part-way along the length of the blank, representing the beginning of creating a first purfling strip. After completing the cutting of the segments for the first purfling strip, the laser cutter then cut additional discrete lines of such purfling strip segments, thereby separating the segments in the respective lines from the display material segments in adjacent lines, until substantially the full width of the blank had been so fabricated. The laser cutter then made straight line cuts in the substrate layer between the purfling strip patterns, and between the left-most pattern and the left edge of the blank, and between the right-most pattern and the right edge of the blank, thereby separating the respective lines from each other; and from the edges of the blank.

The so-fabricated workpiece, bearing the cuts made by the laser cutter, was then removed from the laser cutter. The individual purfling strips were then removed from the backing board, and any of the 2-sided tape which stuck to the purfling strips was removed, yielding a plurality of flexible purfling strips, each about ⅛ inch wide and having its own pattern of display layer segments, and spaces between the segments, cut entirely through the display layer material.

A representative such elongate purling strip was readily resiliently flexible to a substantial degree about an axis extending perpendicular to the top and bottom surfaces of the strip, and about an axis which extended perpendicularly across the width of the strip. The strip was easily elongated, with corresponding reduction in thickness and width, by a tensile force applied to the respective ends. The ability to flex the respective purfling strip about a curvature having a radius of about 1 inch, or greater, was largely unaffected by the pattern of display segments represented in FIG. 4.

In another purfling strip, wherein the segments were somewhat farther apart, and using a pattern where none of the segments had continuous widths which approached the overall width of the purfling strip, the ability to flex the respective purfling strip about a curvature having a radius of about 0.5 inch was largely unaffected by the pattern of display segments.

While the respective materials used in the display layer have their own characteristic colors, the color of such materials can also be controlled by applying colorant coatings, stains, and the like to the display material at the top surface of the respective layer, whereby the color expressed by the display layer may be different from the color characteristics inherent in the display layer material.

The overall thickness of the purfling strip must be great enough to provide structural integrity to the purfling strip as an inlay product, such that manufacture, handling and performance of the inlay product is facilitated. However, the maximum allowable thickness is limited by the thickness of the parent product into which the purfling strip inlay product is to be incorporated.

Depending on the thickness of the substrate material, the thickness of the purfling strip can be as small as about 0.02 inch to as great as about 0.4 inch. However, given the high cost of the types of materials typically used as the display material, lesser thicknesses in the afore-mentioned range are more common. Thus, thicknesses of about 0.02 inch to about 0.1 inch are more common.

Thus for example, where the purfling strip is to be incorporated into an otherwise unsupported portion of a top plate of a stringed instrument such as a guitar, having a top plate thickness of about 0.07 inch to about 0.08 inch thickness, the depth of the channel 41 which receives the purfling must be less than the about 0.07 inch to about 0.08 inch thickness of the top plate. A typical depth of such channel is about 0.05 inch, whereby thickness of the purfling strip assembly in such instance is more or less about 0.05 inch. Of that 0.05 inch thickness of the purfling strip, the substrate may be about 0.03 inch and the display layer is the remainder of the thickness, attributing no meaningful separate thickness for any adhesive layer which bonds the display layer to the substrate layer.

A purfling strip of the invention is contemplated to be mounted into a parent material of a parent product, such as a stringed musical instrument. Returning to FIGS. 1, 2, and 3, a channel illustrated at 41 in FIG. 3 is fabricated in the respective plate, e.g. the top plate, of the instrument along any straight or curvilinear path desired. Where the channel is located at the edge of the sound box, the corresponding strip is known as a purfling strip. Where the channel is located away from the edge of the sound box, and away from the sound aperture, the corresponding strip may be known as a back strip on the bottom plate, as a front strip on the top plate, or as a side strip on the side plate. An appropriate strip is then adhesively mounted in the channel, flexing the strip as needed, especially about an axis perpendicular to the side edges of the strip, to accommodate any curvature in the path of the channel. Where the channel is longer than a respective inlay strip, additional inlay strips are mounted in the channel end-to-end, until the entire length of the channel has been so populated with inlay strips.

After the inlay strip(s) have been mounted in the channel, a conventional filler such as epoxy, with or without colorant and/or particulate material, may be used to fill in the spaces between display layer segments. Once the filler has hardened, the inlay strip is no longer overall flexible with respect to the channel, and is a permanent part of the parent product into which it has been incorporated. Further finishing steps can be practiced on the parent product as desired, including on the so-filled inlay strip. In musical instruments, finish materials which are used to finish the instrument are applied to the inlay strip as well, such that the final layer or layers of finish materials coat the inlay strip with the same material that is used to coat the material of the parent product into which the inlay strip is incorporated.

Attention is now directed to FIG. 1, and rosette 29 which generally surrounds the sound aperture. Rosette 29, as illustrated, is a decorative inlay strip which forms a complete perimeter about the sound aperture, including under neck 14.

FIG. 7 illustrates the type of detail which can be created in rosette band inlay strips made according to methods of the invention. The rosette inlay strip illustrated in FIG. 7 is circular. The rosette inlay strip of FIG. 7, also shown on a backing board 66 in FIG. 10, has a top 68, a bottom 70, a thickness between the top and the bottom, an inner perimeter designated 72, an outer perimeter designated 74, and a width between the inner and outer perimeters. First and second perimeter dams 76 extend along the entireties of the inner and outer perimeters of the strip, and extend along the thickness of the rosette inlay strip between the top and the bottom, specifically to the top of the rosette inlay strip.

Between the inner and outer dams 76, namely in the interior of the rosette inlay strip, a pattern of cuts extends down from the top of the rosette toward the bottom. The pattern elements 78 represent face material which has not been cut away from the blank which is used in fabricating the rosette. The spaces 80 between the uncut pattern elements 78, and between uncut pattern elements and the dams 76, define cavities 82 in the so-cut rosette. Such cavities extend from the top of the rosette downwardly toward the bottom of the rosette.

Cavities 82 are filled with filler material 84 such as reaction curable epoxy or other suitable material, with or without colorant and/or with or without other particulate filler. Filler material 84 is illustrated as the solid black background material in FIG. 7.

A circular wood rosette inlay strip such as that illustrated in FIG. 7 can be made as follows.

Figure 8:
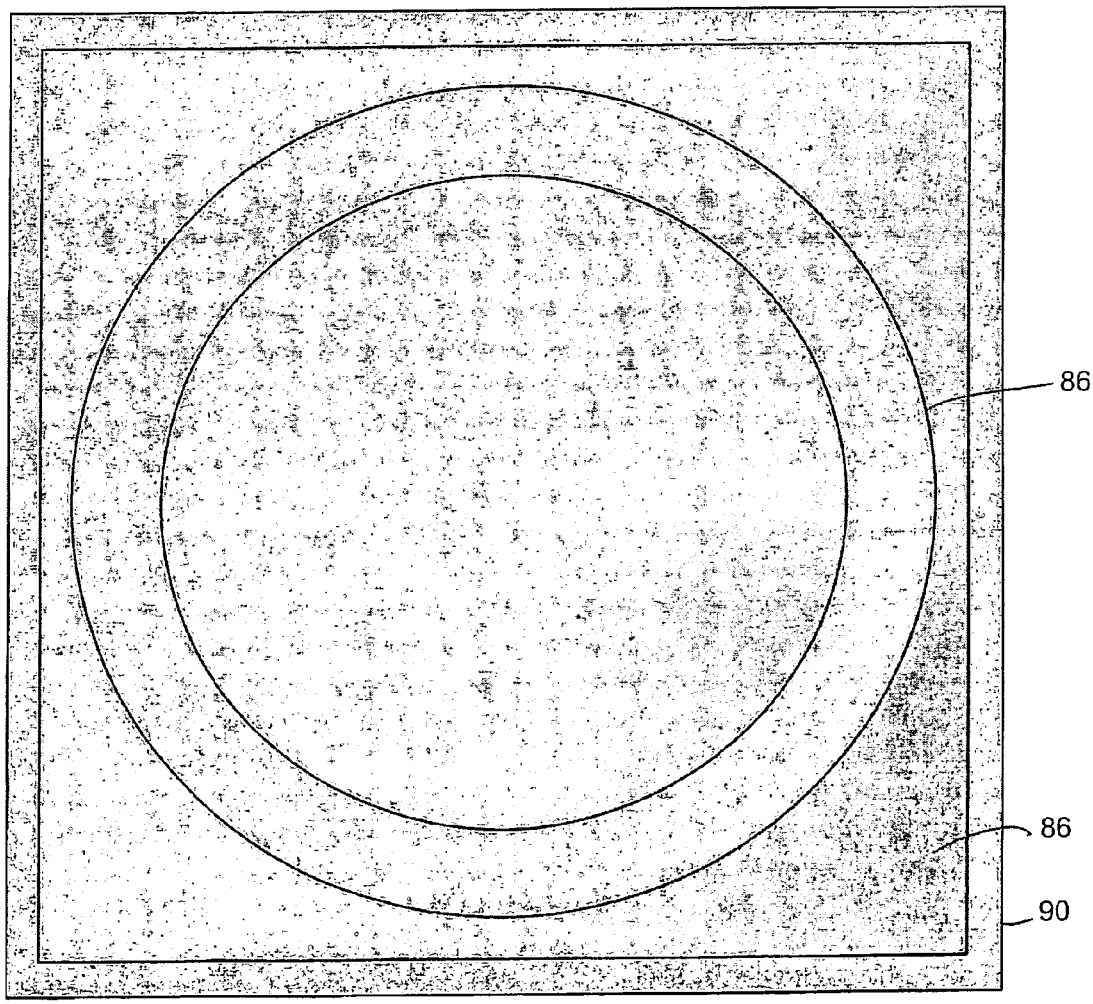
FIG. 8 is a top view of a rosette work piece mounted to a backing board during fabrication of the rosette ring.
Figure 10:
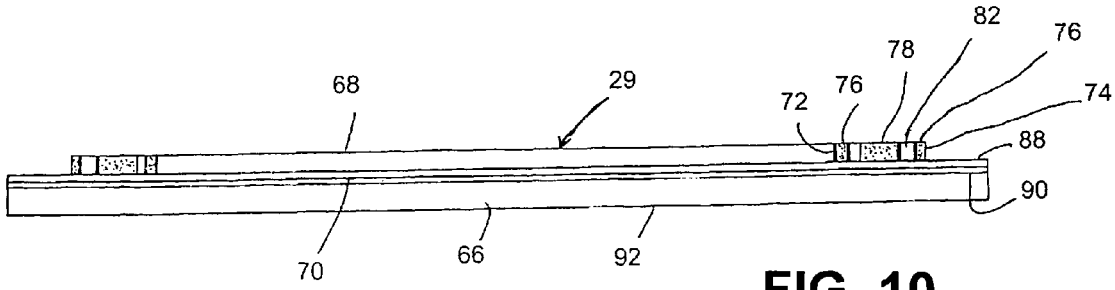
FIG. 10 is a side view of the rosette ring work piece and backing board of FIG. 9 after the pattern and dams have been cut in the rosette ring, and the waste material has been removed, but before the rosette ring has been removed from the backing board.

A suitable wood substrate having a desirable perimeter, within which the rosette inlay strip can be fabricated, is selected. An exemplary such substrate is a wood veneer ring 86 about 0.06 inch thick having both an inner perimeter and an outer perimeter. Referring to FIG. 10, the wood veneer ring is adhesively mounted to a thin sheet substrate 88 which extends across the full diameter of the wood veneer ring, including across the central open space between respective portions of the inner perimeter. Using 2-sided pressure sensitive tape 90, the thin sheet substrate, with the wood veneer circle mounted thereon, is mounted to a rigid backing board 92, ⅛ inch thick, to make a rosette inlay strip workpiece. The so-fabricated workpiece is represented, generally, in FIG. 8.

The backing board was a wood-based high-density fiberboard sometimes known as Masonite®. The so-mounted rosette inlay strip workpiece was then mounted in a laser cutting machine driven by a PLC. The PLC was programmed with a suitable pattern of rosette design to be cut into wood veneer layer. The designed cut included leaving dams 76 as uncut material, whereby the dams extend to the top of the veneer. The designed cut also included leaving the raised pattern uncut, whereby the non-pattern material was cut away, leaving both the dams and the pattern design as original thickness material.

Dams 76 serve as fluid flow barriers to inhibit flow of fluid filler material out of the cavities 82 during the process of finishing the rosette inlay strip, as discussed hereinafter. Accordingly, the heights of the dams are typically the same as the heights of the uncut pattern segments. The widths of the dams can be any width which is effective to provide the designed inhibition of fluid flow, along with enough strength to ensure structural integrity of the respective dams. A typical width is about 1 mm.

As part of the cutting process, cut lines are formed through the wood veneer material at the inner limit of the inner dam and at the outer limit of the outer dam, which separates inner and outer waste wood veneer material from the thus-created patterned rosette inlay strip.

The so-fabricated rosette workpiece, bearing the cuts made by the laser cutter, was removed from the laser cutter. The cut-away waste veneer material inside the inner edge of the inner dam, and outside the outer edge of the outer dam, was removed, along with those portions of the underlying thin sheet substrate and the 2-sided tape which did not underlie the so-fabricated rosette workpiece. FIG. 9 is a representative top view of the rosette workpiece which remained mounted on the backing board after the removal of such waste material.

FIG. 10 is a cross-section through the structure of FIG. 9, including through the backing board, the 2-sided tape, the thin sheet substrate, and the veneer wood layer.

With the rosette inlay strip workpiece 86 still mounted on the backing board, the cavities 82 are filled with any desired filler material. The filler material can be either a thermoplastic composition or a reaction curable liquid or paste-consistency composition, with or without colorant, with or without particulate material inclusions, or any other material which is fluid or semi-fluid, or paste consistency, which can be caused to harden to a generally solid consistency in an acceptable period of time. The filler material is used to fill the cavities while the filler material is pliable, thus to present a relatively constant-level top surface of filler material, generally at the same elevation as the uncut material of the wood pattern.

As suggested earlier, the function of dams 76 is to retain the filler material in the cavities while the filler material hardens/sets, thus preventing the filler material from flowing beyond the inner and outer perimeters. The resulting product is a filled ring-shaped rosette inlay strip, still on the backing board, wherein filler material occupies all of the spaces defined by cavities 82. The rosette inlay strip can then be sanded to bring the filler and pattern to a common height, which tentatively finishes the structural portion of the fabrication of the rosette inlay strip. One or more sealer and/or other finishing coatings are ultimately applied to the rosette inlay strip by the time the rosette inlay strip has been fully incorporated into a completely finished e.g. stringed musical instrument. After the rosette inlay strip has been sanded, the rosette inlay strip can be removed from the backing board and from the 2-sided tape, and sealed with a conventional sealer, whereupon the rosette inlay strip is ready to be mounted in the guitar or other musical instrument. Such sealant can, in the alternative, be applied before the rosette inlay strip is removed from the backing board, or after the rosette inlay strip has been mounted to a stringed instrument structure. The rosette ring insert shown in FIG. 7 generally illustrates the color contrast which can be achieved, after sanding and sealing, where a dark colored, e.g. black, filler material is used in combination with a very light-colored wood in the rosette ring.

Since the cavities in the ring-shaped rosette inlay strip, as here fabricated, have already been filled to develop a constant-height surface, there is no need to apply any filler after the rosette inlay strip has been incorporated into the musical instrument, whereby there is no concern about spreading any colored filler material over the top plate of the e.g. guitar, and thus staining the top plate, in the process of mounting and finishing the rosette inlay strip.

As an alternative, the filled rosette inlay strip can be removed from the backing board before the sanding and/or sealing operations are performed.

As another alternative, the rosette ring can be removed from the backing board after the cutting has been completed and before the filler has been added. FIGS. 9-10 show such rosette ring after cutting has created the pattern and before the rosette ring has been removed from the backing board. In FIG. 9, both the face material and the cavities are shown in a common gray color, as is the thin sheet substrate on the backing board. The dams are shown in solid black. As an alternative depiction, the same rosette ring is shown in FIG. 11, after the rosette ring has been removed from the backing board, with the face material and the dams shown in white while the cavities are again shown in gray coloration.

Because of the imposition of the thin sheet substrate between the veneer and the backing board, the cuts involved in cutting the pattern and dams in the veneer can extend through the entirety of the wood veneer; but should not extend through the thin sheet substrate. So long as the thin sheet substrate is not penetrated by the cutting, the filler material does not flow downwardly out of the cavities and, accordingly, does not bond to the underlying 2-sided tape or the underlying backing board, whereby the cut and filled rosette inlay strip can be removed from the backing board as described above.

A suitable and exemplary such thin sheet substrate for mounting on the bottom of the wood veneer, and thus for containing the filler if the full thickness of the veneer ring is fully penetrated by the cutting, is without limitation, known as a Vulcanized Fiber substrate, available from Luthier's Mercantile International, Windsor, Calif. Such Vulcanized Fiber substrate consists of partially regenerated cellulose having a thickness of 0.10 inch, density of 1.2 gm/cc, MD tensile strength of 21,000 psi, CD tensile strength of 10,000 psi, MD tear strength of 550 grams, and CD tear strength of 700 grams.

The method taught herein for fabricating a circular rosette inlay strip can be used to fabricate a wide variety of inlay strips having patterns fabricated between opposing side dams. Thus, what is here described in terms of a circular rosette inlay strip can be fabricated into essentially any desired closed-strip configuration having both an inner dam at the inner perimeter edge and an outer dam at the outer perimeter edge. Both the inner dam and the outer dam extend about the entireties of their respective perimeter edges. Thus, there can be mentioned circles, ovals, rectangles, pentagons, stars, and any other closed-strip configuration. The strip can be open, not a closed configuration, such as a ring-type configuration having an opening therein between facing ends. In such open-strip configuration, end dams are also provided at the ends, and extend from the inner dam to the outer dam.

The inlay strip fabricated according to the method, described for the rosette inlay strip, can have any desired shape, including both closed-strip configurations and open-strip configurations. Thus, the methods of the invention can be used to make such open-strip configurations as zigzag strips, curvilinear strips, and literally any shape elongate strip contemplated by the user.

The width of the inlay strip can be constant as shown, or can vary along the length of the strip according to essentially any design. The only design requirements for such strip products is that they have first and second opposing border dams capable of containing the filler material while the filler material is fluid, and dams extending across any ends.

Referring to FIGS. 2, 4-7, 9, and 11, it is seen that the use of a laser cutter enables the creation of a wide range of cut patterns in inlay strips of the invention. Thus, FIGS. 2 and 4-6 illustrate the creation of various fanciful and representational designs. FIGS. 7, 9, and 11 illustrate the creation of fanciful designs in combination with known letters and numbers, and further illustrate that even the known characters can be expressed in fanciful representations. Thus the limitations on the design of the display surfaces of conventional inlay strip products is not a constraint in inlay strip products of the invention. Accordingly, inlay strip products of the invention can include in the design, unlimited surface pattern variations including letters, numbers, and very small cavities of any desired length-and-width configuration.

Although the invention has been described with respect to various embodiments, it should be realized this invention is also capable of a wide variety of further and other embodiments within the spirit and scope of the appended claims.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. An elongate decorative strip inlay product having a top, a bottom, opposing first and second sides between the top and the bottom, a length, a width of about 0.03 inch to about 1.5 inches between the first and second sides, and a thickness of about 0.03 inch to about 0.4 inch between the top and the bottom, said elongate decorative strip inlay product comprising:

(a) a flexible, relatively underlying, layer of substrate material extending the length and width of said elongate decorative strip inlay product; and (b) a relatively overlying layer of display material, affixed to said substrate layer, said layer of display material comprising a plurality of separate and distinct display material segments, spaced from each other, with intervening spaces readily visible to the naked eye between respective ones of the display material segments, such that ones of said display material segments can move relative to each other in accommodation of such flexing of said strip inlay product, wherein a said elongate decorative strip inlay product, which is straight when in a relaxed condition, is sufficiently flexible that said elongate decorative strip inlay product can be flexed, about a vertical axis which is perpendicular to the top and bottom of said decorative strip inlay product, to a curvature representing a radius of no more than 5 inches.

2. An elongate decorative strip inlay product as in claim 1 wherein ones of said display material segments overlap each other along the length of said strip inlay product.

3. An elongate decorative strip inlay product as in claim 2 wherein ones of said display material segments are substantially less flexible, in such direction of flexing, than said substrate material.

4. An elongate decorative strip inlay product as in claim 1 wherein said display material comprises a plurality of segments of said display material extending, side-by-side, along the length of said inlay product, at least one said segment of said display material having a width, along a portion of said segment, substantially less than the width of said strip inlay product, and wherein said at least one segment can flex in accommodating such flexing of said strip inlay product.

5. An elongate decorative strip inlay product as in claim 4 wherein said plurality of side-by-side segments can collectively flex in accommodating such flexing of said strip inlay product.

6. An elongate decorative strip inlay product as in claim 1 wherein a composition of said display material is selected from the group consisting of wood, bamboo, bone, ivory, polymer, stone veneer, faux stone, metal, and organic shell.

7. An elongate decorative strip inlay product as in claim 1 wherein said substrate material comprises elastomeric material.

8. An elongate decorative strip inlay product as in claim 1 wherein said substrate material comprises a composition selected from the group consisting of natural rubber and synthetic rubber.

9. An elongate decorative strip inlay product as in claim 8 wherein said substrate layer is about 0.025 inch thick to about 0.06 inch thick.

10. An elongate decorative strip inlay product as in claim 7 wherein said substrate layer has a hardness of about 25 to about 75 on the Shore A scale.

11. An elongate decorative strip inlay product as in claim 1 wherein said substrate layer comprises synthetic rubber about 0.02 inch thick to about 0.04 inch thick, having a hardness of about 35 to about 65 on the Shore A scale, and wherein said overlying layer comprises a plurality of display material segments having hardnesses greater than 75 on the Shore A scale, which display material segments can move relative to each other in accommodating such flexing of said strip inlay product.

12. An elongate decorative strip inlay product as in claim 1, wherein said substrate layer has a hardness of about 25 to about 75 on the Shore A scale, and said strip inlay product has an average width of about 0.03 inch to about 1 inch.

13. An elongate decorative strip inlay product as in claim 1, wherein said substrate layer has a hardness of about 35 to about 65 on the Shore A scale, and said strip inlay product has an average width of about 0.06 inch to about 0.75 inch.

14. A stringed instrument comprising an elongate strip decorative inlay product as in claim 1, received in a curved channel at an edge of a visible layer of said stringed instrument.

15. A stringed instrument as in claim 14, said overlying layer comprising filler material in the spaces between said display material segments, said filler material and such channel each precluding subsequent flexing of said elongate inlay product.

16. A method of making an elongate decorative strip inlay product having a top, a bottom, opposing first and second sides between the top and the bottom, a first length, a first width of about 0.03 inch to about 1.5 inches between the first and second sides and transverse to the length, and a thickness of about 0.03 inch to about 0.4 inch between the top and the bottom, the method comprising:

(a) providing a backing board;

(b) mounting a multiple-layer sheet structure on the backing board to create an inlay workpiece, the multiple layer sheet structure comprising (i) a flexible, relatively underlying, layer of substrate material having a second length, and a second width greater than the first width, and (ii) a relatively overlying layer of display material, affixed in the multiple layer sheet material, the overlying layer having a top and a bottom, a third length, and a third width greater than the first width;

(c) cutting the overlying layer, from the top to the bottom of the overlying layer so as to create discrete display material segments, separate and distinct from each other along a plurality of discrete lines of such segments, thereby separating the display material segments in a first such line from the display material segments in adjacent such lines;

(d) cutting through the substrate material between respective ones of the discrete lines thereby to separate individual decorative strips from the blank and from each other; and (e) separating individual ones of the decorative strips from the backing board.

17. A method as in claim 16 wherein the cutting of the overlying layer so as to create distinct segments separates the display material in a given such line into distinct segments wherein the segments in such first line are separated from each other.

18. A method as in claim 16 wherein the cutting of the overlying layer so as to create distinct segments separates the display material in a given such line into distinct segments spaced from each other longitudinally along the length of the given line.

19. A decorative strip inlay product having a top, a bottom, opposing first and second elongate sides extending between the top and the bottom, said first side having a first length and said second side having a second length, a width of about ¼ inch to about 1 inch between the first and second sides, and a thickness of about 0.03 to about 0.4 inch between the top and the bottom, said decorative strip inlay product comprising:

(a) a first dam at the first side of said decorative strip, and extending along the full length of the first side;

(b) a second dam at the second side of said decorative strip, and extending the full length of the second side;

(c) a display pattern of face material between said first and second dams and extending downwardly from the top of said strip inlay product; and (d) one or more cavities defined between respective portions of the display pattern and/or between respective portions of the display pattern and one or more of the first and second dams, said first and second dams and said face material expressing properties which reflect said dams and at least a portion of said face material having been derived from a common work piece.

20. A decorative strip inlay product as in claim 19 wherein said dams and said at least a portion of said face material are wood, and have a common grain direction and a common species.

21. A decorative strip inlay product as in claim 19, further comprising a thin sheet substrate underlying, and attached to, said dams and said face material.

22. A decorative strip inlay product as in claim 19, further comprising one or more filler materials filling the cavities.

23. A method of fabricating a decorative strip inlay product having a top and a bottom, opposing first and second elongate sides extending between the top and the bottom, the first side having a first length and the second side having a second length, a width between the first and second sides, and a thickness between the top and the bottom, the method comprising:

(a) selecting a suitable substrate workpiece within which the decorative strip inlay product can be fabricated;

(b) releasably mounting the selected workpiece on a backing board to make a workpiece assembly having a top and a bottom, a top of the substrate workpiece being defined by face material and corresponding with the top of the workpiece assembly, a bottom of the substrate workpiece facing a top of the rigid backing board;

(c) mounting the workpiece assembly in a laser cutting machine so as to apply cutting energy at the top surface of the workpiece assembly;

(d) applying the laser cutting machine at the top of the workpiece assembly and thereby (i) cutting through the workpiece assembly from the top of the substrate workpiece to the bottom of the substrate workpiece, and thereby defining first and second elongate sides of the decorative strip, cut entirely through the substrate workpiece and thereby severing waste material of the substrate workpiece from the remainder of the substrate workpiece; and (ii) cutting into and not through the substrate workpiece between the first and second elongate sides and thereby creating (A) a first dam at the first side of the decorative strip and extending along the full length of the first side, (B) a second dam at the second side of the decorative strip and extending along the full length of the second side, (C) a display pattern of uncut portions of the face material between the first and second dams, and (D) one or more cavities defined between respective portions of the display pattern and/or between respective portions of the display pattern and one or more of the first and second dams;

(e) removing the severed waste material from the workpiece assembly, thereby leaving on the backing board a precursor of the decorative strip inlay product;

(f) filling the cavities with one or more filler materials; and (g) sanding the top of the resultant product precursor, resulting in display of both the filler material and the full pattern of the facing material as cut by the laser cutter, and producing the decorative inlay strip product.

24. A method as in claim 23, further comprising applying a sealer to the top surface of the decorative inlay strip product.

25. A method as in claim 24, further comprising removing the decorative strip product from the backing board after applying the sealer.

26. A method as in claim 24, further comprising removing the decorative strip product from the backing board, and subsequently applying the sealer to the decorative strip product as a stand-alone strip product.

27. A method as in claim 24 wherein the strip product is a closed-strip configuration.

28. A method as in claim 24 wherein the strip product is an open-strip configuration having at least a first end extending between the first and second sides, and further comprising a third dam connecting the first and second sides at the first end.

29. A method as in claim 23 wherein the substrate workpiece comprises a first relatively overlying display layer, and a second relatively underlying thin sheet affixed to the overlying display layer.

30. A method as in claim 29 wherein the underlying thin sheet comprises a vulcanized fiber substrate comprising at least partially regenerated cellulose fibers.

* * * * *